United States Patent [19]

Watai et al.

[11] Patent Number: 4,460,270

[45] Date of Patent: Jul. 17, 1984

[54] AUTOMATIC EXPOSURE CONTROL FOR A PHOTOCOPYING MACHINE

[75] Inventors: Yuji Watai; Toshiyuki Kitamura; Yoshiyuki Hirayama; Akira Matsuura; Hirokazu Yasui, all of Kanagawa, Japan

[73] Assignee: Fuji Xerox Co., Ltd., Tokyo, Japan

[21] Appl. No.: 404,740

[22] Filed: Aug. 3, 1982

[30] Foreign Application Priority Data

Aug. 3, 1981 [JP] Japan ..... 56/122320

[51] Int. Cl.[3] ..... G03G 15/00

[52] U.S. Cl. ..... 355/14 E; 353/3 R; 353/14 R; 118/691; 430/30

[58] Field of Search ..... 355/14 E, 14 CH, 14 D, 355/3 R, 14 R, 3 CH; 118/668, 646, 651, 691, 693; 430/30

[56] References Cited

U.S. PATENT DOCUMENTS

| | | | |
|---|---|---|---|
| 3,926,518 | 12/1975 | Berry et al. | 355/14 E X |
| 4,153,364 | 5/1979 | Suzuki et al. | 355/14 E |
| 4,215,930 | 8/1980 | Miyakawa et al. | 355/14 E X |
| 4,284,344 | 8/1981 | Okamoto et al. | 355/14 E |
| 4,390,266 | 6/1983 | Uchida | 355/14 E |

*Primary Examiner*—A. C. Prescott

*Attorney, Agent, or Firm*—Sughrue, Mion, Zinn, Macpeak & Seas

[57] ABSTRACT

An automatic exposure control method for a photocopying machine is disclosed herein. A sensor is periodically interposed in the light path of the photocopier, which samples the intensity of the light produced by the light producing system. This intensity is compared with a signal representative of the optimum light intensity for the photosensitive drum, and the light source is controlled by inputting the resulting intensity control signal to a voltage regulated light source control device.

5 Claims, 1 Drawing Figure

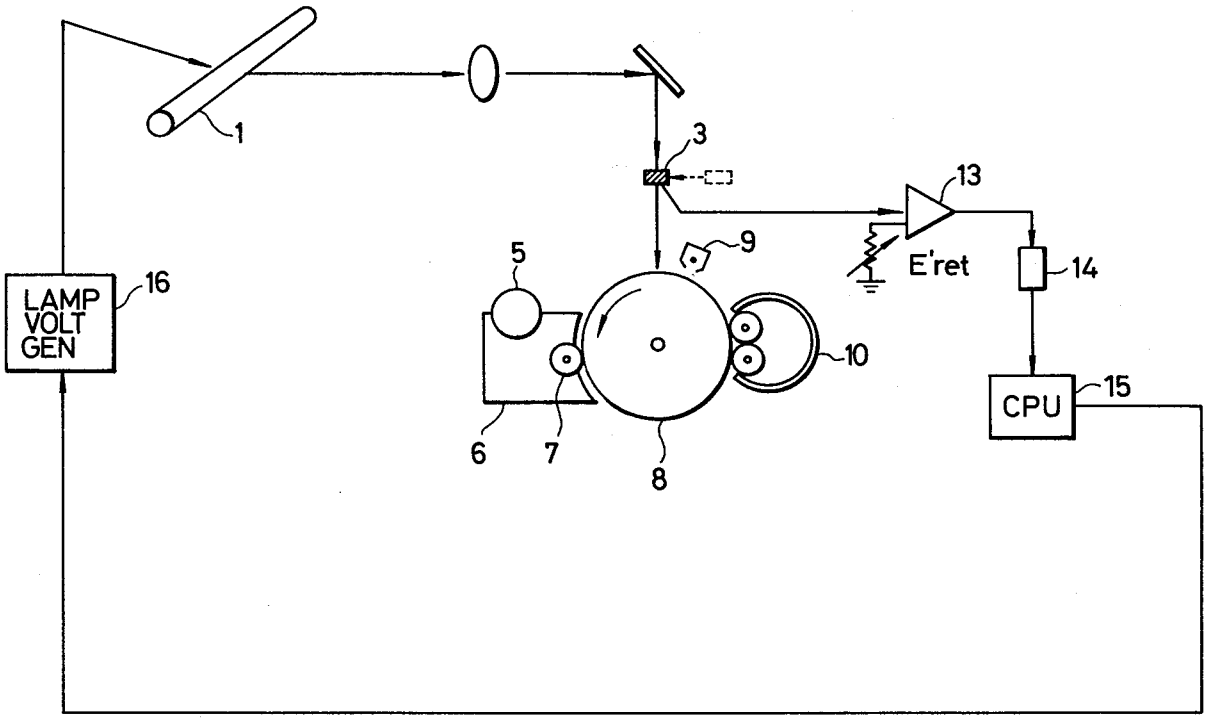
1
3
5
6
7
8
9
10
13
E'ret
14
15
CPU
16
LAMP
VOLT
GEN

AUTOMATIC EXPOSURE CONTROL FOR A PHOTOCOPYING MACHINE

BACKGROUND OF THE INVENTION

This invention relates to a method in which a voltage applied to an exposure lamp for irradiating an original in a copying machine is controlled to vary the amount of light produced by the exposure lamp.

In a typical photocopying machine, the amount of light produced by the exposure lamp is liable to vary with time, the surface of the light collecting lens is liable to become dirty, or the surface of the mirror utilized to apply the light to the drum is liable to become dirty. All these factors contribute to variation in light quantity or the degrees of contamination, i.e., the degree of deterioration of the optical system. These factors in turn depend upon the frequency of operation of the copying machine as well as the environmental conditions surrounding the copying machine. Thus, the light producing system of a conventional copying machine is disadvantageous in that different copying machines are different in the degree of deterioration of the optical systems thereof, and accordingly, differ in the frequency of required maintenance work.

SUMMARY OF THE INVENTION

An object of the present invention is thus to provide a light producing system for a photocopying machine in which the intensity of the light produced by the system is constant throughout the life of the copier.

This and other objects of the present invention are realized by providing a light producing system for a copying machine which can automatically increase the amount of light of the exposure lamp to its optimum value. That is, the invention provides an automatic exposure control method by which the frequency of maintenance work can be decreased.

BRIEF DESCRIPTION OF THE DRAWING

The single FIGURE is a diagrammatic view of the optical system in a copying machine which provides the automatic exposure control method of the present invention.

DESCRIPTION OF THE PREFERRED EMBODIMENT

This invention will be described with reference to the accompanying drawing.

In the single FIGURE, reference numeral 1 designates an exposure lamp; 3, an optical intensity sensor; 5, a toner supply motor; 6, a developing unit; 7, a developing bias electrode; 8, a photosensitive drum of selenium; 9, a charge corotron (charging); 10, a cleaning unit; and 16, a lamp voltage regulator.

The method of the invention is based on the recognition that, at a suitable time during the use of the copying machine, an optical intensity sensor can be set within the optical path between a mirror 2 and the drum 8, such that the output of the sensor 3 can control the intensity of the exposure lamp, increasing the intensity to the point where a copying operation can be effected satisfactorily even under the condition of optical system deterioration as described above. Thererfore, the optical intensity sensor 3 is so designed as to go into and out of the optical path by motion being produced by a solenoid (not shown). The quantity of light applied to the drum is detected by the sensor 3. The output of the sensor 3 is applied to an operational amplifier 13, where it is compared with a reference voltage $E_{ref}$ which is determined from the optimum intensity of the light with respect to the sensitivity of the photosensitive drum (the reference voltage being determined via experimentation). The analog output of the operational amplifier 13 is converted into a digital signal by an A/D converter 14, the output of which is applied to a CPU (central processing unit) 15. The output of the CPU is used to drive a lamp voltage regulator 16, so as to control the voltage applied to the lamp and the corresponding light intensity. A suitable CPU can be chosen from any number of commercially available processors.

In the manner of the present invention as described above, the amount of light which is actually applied to the drum can be detected. Accordingly, the device can automatically correct or compensate for either a decrease in the intensity of the lamp or for the contamination of the optical system. As a result, the frequency of manual maintenance work can be reduced. Furthermore, if the light intensity of the lamp is too great, it can be reduced by controlling the reference voltage of the operational amplifier.

It is apparent that modifications of this invention can be realized without departing from the essential scope of the invention.

What is claimed is:

1. In a photocopying machine in which a light source provides light within an optical path to a photosensitive drum to record an image, the improvement comprising:

a light sensor which during a sampling period is inserted into said optical path and senses the intensity of said light in said optical path and produces an output, said light sensor being removed from said optical path after the sampling period, said sampling period recurring periodically; and control means for varying the intensity of said light source as a function of said output signal and maintaining said intensity until the next sampling period.

2. The photocopying machine of claim 1, wherein said control means comprises means for comparing said output signal of said light sensor with a signal corresponding to an optimum level of said intensity of said light in said optical path.

3. The photocopying machine as in claim 2, wherein said optimum level signal is generated as a function of the optimum light intensity for the proper operation of said photosensitive drum.

4. The photocopying machine of claim 2, wherein said control means further comprises an analog-to-digital converter, a central processing unit, and a voltage-controlled lamp regulator.

5. An automatic exposure control method for a photocopying machine in which a light source provides exposure light through a light providing system, comprising the steps of:

inserting a movable optical detector into the path of light outputted through said light receiving means;

sampling said exposure light outputted through said light providing system with said optical detector; and altering said light source automatically to maintain an optimum level of said exposure.

* * * * *